US009737775B2

(12) United States Patent
Brunski et al.

(10) Patent No.: US 9,737,775 B2
(45) Date of Patent: Aug. 22, 2017

(54) SYSTEMS AND METHODS FOR FITTING GOLF CLUBS

(71) Applicant: DUNLOP SPORTS COMPANY, LTD., Kobe (JP)

(72) Inventors: Jeffrey D. Brunski, Los Angeles, CA (US); Matthew R. Daraskavich, Huntington Beach, CA (US); Brian D. Schielke, Los Angeles, CA (US); Dan S. Nivanh, Tustin, CA (US)

(73) Assignee: DUNLOP SPORTS CO. LTD., Kobe (JP)

( * ) Notice: Subject to any disclaimer, the term of this patent is extended or adjusted under 35 U.S.C. 154(b) by 143 days.

(21) Appl. No.: 13/841,598

(22) Filed: Mar. 15, 2013

(65) Prior Publication Data

US 2014/0045604 A1 Feb. 13, 2014

Related U.S. Application Data

(60) Provisional application No. 61/680,614, filed on Aug. 7, 2012.

(51) Int. Cl.

| | |
|---|---|
| ***A63B 53/00*** | (2015.01) |
| ***A63B 55/00*** | (2015.01) |
| ***A63B 59/00*** | (2015.01) |
| ***A63B 60/42*** | (2015.01) |
| *A63B 53/04* | (2015.01) |
| *A63B 53/10* | (2015.01) |
| *A63B 55/10* | (2006.01) |

(52) U.S. Cl.

CPC ..... *A63B 59/0074* (2013.01); *A63B 60/42* (2015.10); *A63B 53/00* (2013.01); *A63B 53/04* (2013.01); *A63B 53/10* (2013.01); *A63B 55/10* (2013.01); *A63B 2053/005* (2013.01)

(58) Field of Classification Search

USPC ..... 473/288, 290, 324, 409

See application file for complete search history.

(56) References Cited

U.S. PATENT DOCUMENTS

| | | | | |
|---|---|---|---|---|
| 1,697,846 A | | 1/1929 | Anderson | |
| 1,818,359 A | | 8/1931 | Samaras et al. | |
| 3,840,231 A | | 10/1974 | Moore | |
| 3,931,969 A | | 1/1976 | Townhill | |
| 4,340,227 A | * | 7/1982 | Dopkowski ..... | A63B 53/02 206/315.2 |

(Continued)

FOREIGN PATENT DOCUMENTS

CA 2 270 065 A1 10/2000

OTHER PUBLICATIONS

Golfclubshaftreview.com, Golf Club Shaft Review, 2011, Golfclubshaftreview.com, 1 page.*

(Continued)

*Primary Examiner* — Gene Kim
*Assistant Examiner* — Matthew B Stanczak
(74) *Attorney, Agent, or Firm* — Oliff PLC

(57) ABSTRACT

A system for fitting golf clubs to golfers that enables an overall club length to be varied without varying a length of a shaft. The system enables a greater number of combinations of club characteristics, such as shaft flex, brand, and length, to be contained within a club fitting cart and/or for a same number of combinations of club characteristics to be contained within a smaller cart.

7 Claims, 3 Drawing Sheets

(56) References Cited

U.S. PATENT DOCUMENTS 4,715,601 A * 12/1987 Lamanna ..... A63B 53/04 473/291
4,840,380 A 6/1989 Kajita et al.
4,913,435 A * 4/1990 Kobayashi ..... A63B 53/04 473/242
4,943,059 A 7/1990 Morell
5,067,711 A * 11/1991 Parente ..... A63B 53/00 473/291
5,083,779 A 1/1992 Ungermann
5,222,734 A * 6/1993 Parente ..... A63B 53/00 473/305
5,316,297 A * 5/1994 Chappell ..... A63B 53/02 473/291
5,320,347 A * 6/1994 Parente ..... A63B 53/00 473/305
5,377,978 A * 1/1995 Lee ..... A63B 53/00 473/291
5,429,353 A * 7/1995 Hoeflich ..... A63B 53/04 473/291
5,547,426 A * 8/1996 Wood ..... A63B 53/04 473/290
5,580,051 A 12/1996 Fisher
5,616,086 A * 4/1997 Chappell ..... A63B 53/02 473/287
5,795,240 A * 8/1998 Chappell ..... A63B 53/02 473/291
5,823,887 A * 10/1998 Mikame ..... A63B 53/04 473/290
6,039,659 A * 3/2000 Hamm ..... A63B 53/02 473/306
6,371,865 B1 * 4/2002 Magliulo ..... A63B 69/3685 473/220
6,371,866 B1 * 4/2002 Rivera ..... A63B 53/00 473/256
6,599,202 B2 * 7/2003 Miyamoto ..... A63B 53/00 473/289
6,719,648 B1 * 4/2004 Smith ..... A63B 60/42 473/409
7,014,568 B2 * 3/2006 Pelz ..... A63B 53/04 473/287
7,147,570 B2 * 12/2006 Toulon ..... A63B 53/00 473/290
7,195,565 B2 * 3/2007 White ..... A63B 53/00 473/296
7,699,717 B2 4/2010 Morris et al.
7,789,766 B2 9/2010 Morris et al.
7,997,997 B2 8/2011 Bennett et al.
8,533,060 B1 9/2013 Arluna et al.
8,641,547 B2 2/2014 Rauchholz et al.
8,747,248 B2 6/2014 Harvell et al.
9,174,097 B1 11/2015 Dacey et al.
9,403,067 B2 8/2016 Zimmerman et al.
2002/0037774 A1 * 3/2002 Miyamoto ..... A63B 53/00 473/287
2006/0264266 A1 * 11/2006 Jung ..... A63B 53/00 473/282
2008/0254908 A1 10/2008 Bennett et al.
2008/0254909 A1 10/2008 Callinan et al.
2008/0293510 A1 11/2008 Yamamoto
2009/0178950 A1 * 7/2009 Quartarone ..... A63B 53/00 206/579
2009/0326688 A1 * 12/2009 Thomas ..... A63B 69/3623 700/91
2011/0009206 A1 1/2011 Soracco
2011/0118048 A1 5/2011 Soracco et al.

OTHER PUBLICATIONS

Apr. 28, 2015 Office Action issued in Chinese Application No. 201310341990.0.
Mar. 21, 2016 Office Action issued in Chinese Application No. 201310341990.0.
Sep. 26, 2016 Office Action issued in Chinese Application No. 201310341990.0.
Jun. 19, 2017 Office Action issued in U.S. Appl. No. 14/244,714.

* cited by examiner

SYSTEMS AND METHODS FOR FITTING GOLF CLUBS

CROSS-REFERENCE TO RELATED APPLICATION

This application claims priority, under 35 U.S.C. §119(e), from provisional application Ser. No. 61/680,614, filed on Aug. 7, 2012, the entire contents of which are hereby incorporated by reference.

BACKGROUND

Generally, the concepts described herein relate to a golf club (e.g., a driver, fairway wood, iron, wedge, putter, etc.). More particularly, in some embodiments, the concepts described herein relate to customizing golf club fittings. For the sake of clarity and brevity, the concepts will be described in detail below with respect to wedge-type golf clubs, but could applied to any type of golf club.

Each golfer has a different swing type and physical characteristics (e.g., golfer's height, weight, arm-length, etc.). In order to optimize a set of golf clubs (e.g., a set of irons, a set of wedges, or an entire set of golf clubs including irons, wedges, etc.) for any particular golfer, a fitting process is generally employed to determine the proper specifications for each golf club in the golfer's bag.

The golf club fitting process generally requires a golfer to swing a golf club under the supervision of a golf club fitting specialist. Based on the results, the golf club fitting specialist may suggest adjustments to various golf clubs (e.g., switching to a different shaft length, a different shaft stiffness or "flex," etc.), or ask the golfer to try a different golf club altogether. The golfer may continue to swing the adjusted golf club, and further adjustments may be made if necessary. Through this process, the golfer may arrive at a set of custom-fit golf clubs that is deemed to be optimal for that individual.

However, such a process requires the golf club fitting specialist to carry a large number of golf club components, particularly club heads and shafts. For example, for each club head, there may be tens to hundreds of shafts needed to ensure a best fit for a golfer, since shafts come in different lengths, flexes, brands, etc. Typically, to assure that the golfer is provided the opportunity to find the best-fit club, the golfer must be provided with a large number of club heads and club shafts to be combined in various combinations during the fitting process.

With respect to wedges, assuming that the variables for golf club shafts are limited to brand, shaft length, and shaft flex or stiffness, the maximum number of shafts needed to be carried by a golf club fitting specialist to ensure a full library of customization options can generally be calculated with the following expression:

$$S=\Sigma_{i=1}^{n}B\cdot CL\cdot SL, \quad (1)$$

where S is the total number of shafts needed, n represents the number of club heads with different wedge lofts offered, B represents the number of brands offered, CL represents the number of club lengths offered, and SL represents the number of stiffness levels offered. One skilled in the art will understand that this expression may be easily reconfigured to account for additional variables, and is a mere generalization, since not every brand of shaft necessarily offers each length and stiffness.

Assuming that a manufacturer provides club heads with eight different wedge lofts (e.g., 46°, 48°, 50°, 52°, 54°, 56°, 58°, and 60°), and for each wedge loft, two different brands of shafts, with each brand providing five different club lengths at four different stiffness levels (e.g., A-flex, R-flex, S-flex, and XS-flex), the manufacturer may have to provide a fitting specialist with eight wedge heads (one for each of the eight loft angles) and approximately 320 different shafts.

One reason why such a large number of shafts is required is that each different club head may require its own set of customizable shafts. For instance, the recommended shafts for a 46° pitching wedge range from 32.775 inches to 33.775 inches (in 0.5 inch increments), while the recommended shafts for a 58° lob wedge range from 32.405 inches to 33.405 inches (in 0.5 inch increments). Therefore, otherwise similar shafts (e.g. same brand and same flex), cannot be mixed and matched between wedges of different lofts.

However, a typical golf club fitting specialist works at multiple retail fitting sites, and must transport his or her fitting equipment between each fitting site using a "fitting cart." FIG. 1 illustrates an example of a typical "fitting cart" 100. The fitting cart 100 includes storage space for multiple shafts 102, multiple club heads 104, and associated tools (not shown) for securing each head 102 to each shaft 104. The cart 100 further typically includes wheels 106 to enhance its portability. Since storage space within the cart 100 is limited, and since the size of the cart 100 is limited by considerations of weight and portability, it is not practical for the fitting specialist to carry several hundred different shafts.

Thus, one alternative is to limit the golfer to the subset of golf shafts and club heads carried by the golf club fitting specialist. The drawback of this option is that the golf club fitting specialist has a smaller pool of customizations to offer the golfer, which inevitably requires concessions to be made during the golf club fitting process. Therefore, there is a need for a system that allows thorough fitting of wedge-type golf clubs for golfers, while reducing the number of shafts needed to be carried by the golf club fitting specialist.

SUMMARY

The present embodiments have several features, no single one of which is solely responsible for their desirable attributes. Without limiting the scope of the present embodiments as expressed by the claims that follow, their more prominent features now will be discussed briefly. After considering this discussion, and particularly after reading the section entitled "Detailed Description," one will understand how the features of the present embodiments provide the advantages described herein.

One embodiment of this disclosure is a golf club fitting system, comprising a first club head having a first striking face, a first main body, a first hosel extending from the first main body, a first loft angle, and a first hosel length $HL_1$. The system further comprises a second club head having a second striking face, a second main body, a second hosel extending from the second main body, a second loft angle greater than the first loft angle by no more than 15°, and a second hosel length $HL_2$ less than the first hosel length $HL_1$ by at least 0.340 inches.

Another embodiment is a golf club fitting system, comprising a first club head having a first striking face, a first main body, a first hosel extending from the first main body, a first loft angle, and a first hosel length $HL_1$. The system further comprises a second club head having a second striking face, a second main body, a second hosel extending from the second main body, a second loft angle greater than the first loft angle by no more than 5°, and a second hosel length $HL_2$ less than the first hosel length $HL_1$ by at least 0.120 inches.

Still another embodiment is a golf club fitting system, comprising a first club head having a first striking face, a first main body, a first hosel extending from the first main body, a first loft angle $LA_1$, and a first hosel length $HL_1$. The system further comprises a second club head having a second striking face, a second main body, a second hosel extending from the second main body, a second loft angle $LA_2$ greater than the first loft angle by at least 4°, and a second hosel length $HL_2$. The first and second golf club heads satisfy the following: $(HL_1-HL_2)=R*(LA_2-LA_1)$; and R is within the range of 0.025 inches/° to 0.035 inches/°.

A still further embodiment is a golf club fitting system, comprising a first club head having a first striking face, a first main body, a first hosel extending from the first main body, a first loft angle $LA_1$, and a first hosel length $HL_1$. The system further comprises a second club head having a second striking face, a second main body, a second hosel extending from the second main body, a second loft angle $LA_2$ greater than $LA_1$ angle by at least 4°, and a second hosel length $HL_2$. The system further comprises a third club head having a third striking face, a third main body, a third hosel extending from the third main body, a third loft angle $LA_3$ greater than $LA_2$ by at least 4°, and a third hosel length $HL_3$. The first, second and third golf club heads are configured to satisfy the following: $3.66\text{ in}-(0.03125\text{ in}/°)*LA \leq HL \leq 3.78\text{ in}-(0.03125\text{ in}/°)*LA$.

Still another embodiment is a golf club fitting system, comprising a first club head having a first loft greater than 45° and a first hosel length. $HL_1$, a second club head having a second loft greater than the first loft and a second hosel length, $HL_2$, less than the first hosel length and a third club head having a third loft greater than the second loft and a third hosel length, $HL_3$, less than the second hosel length, wherein $HL_1=(HL_2-x)=(HL_3-2x)$.

BRIEF DESCRIPTION OF THE DRAWINGS

The present embodiments now will be discussed in detail with an emphasis on highlighting the advantageous features. These embodiments depict the novel and non-obvious golf club fitting systems and methods as shown in the accompanying drawings, which are for illustrative purposes only. These drawings include the following figures, in which like numerals indicate like parts.

DETAILED DESCRIPTION

The proposed solution offered herein to the problem discussed above involves varying the hosel length of different clubs to enable a golf club fitting specialist to use a shaft of a particular length across different clubs, thereby reducing the total number of shafts that need to be carried by the golf club fitting specialist. And, because a golfer typically only carries a few wedges (e.g., 2 or 3 wedges) as opposed to a more substantial number of irons (e.g., 6+ iron clubs) in his or her golf bag, the below description works particularly well with wedge fitting.

Figure 1:
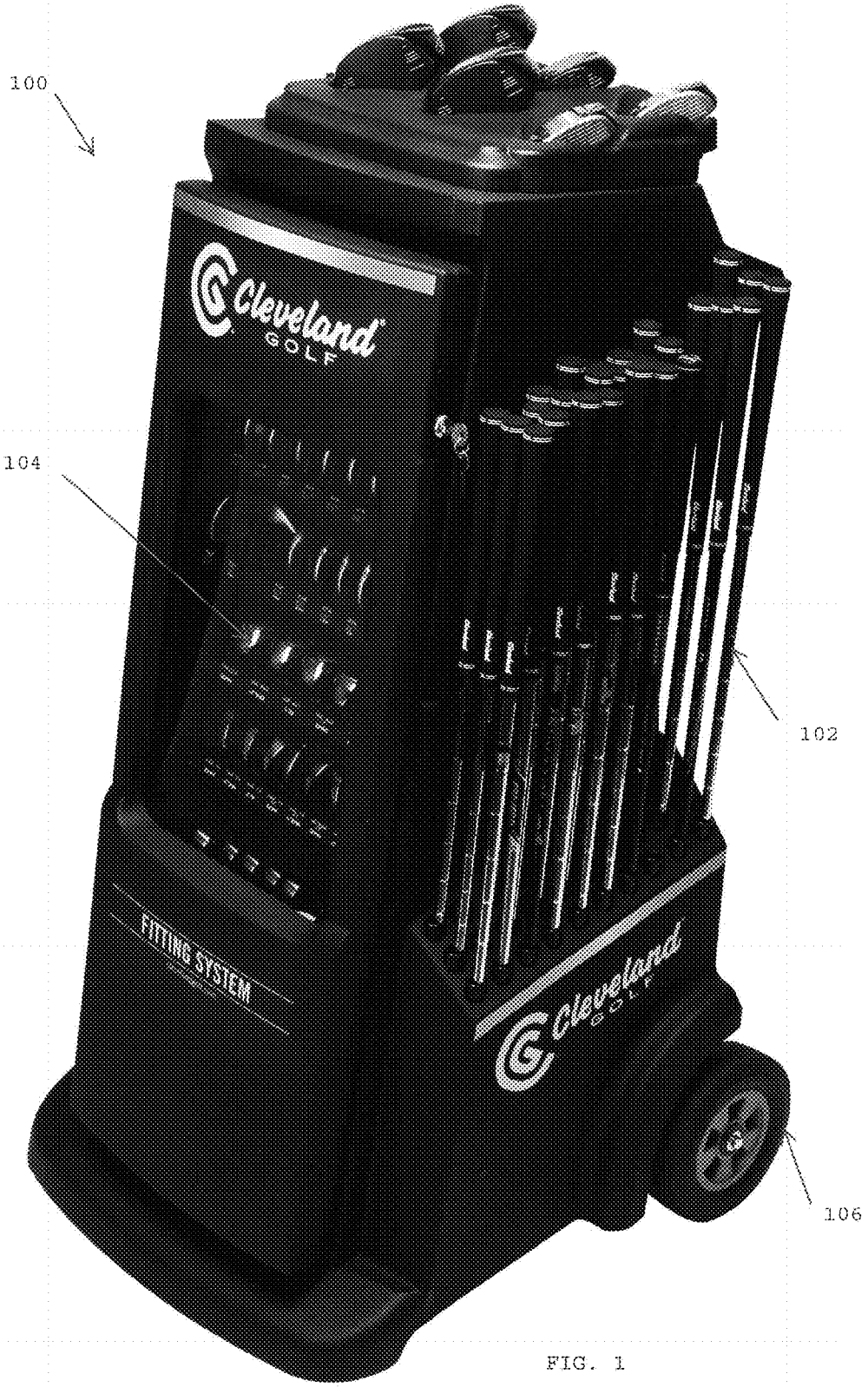
FIG. 1 is a front perspective view of a typical fitting cart for containing and transporting a golf club fitting system.
Figure 2:
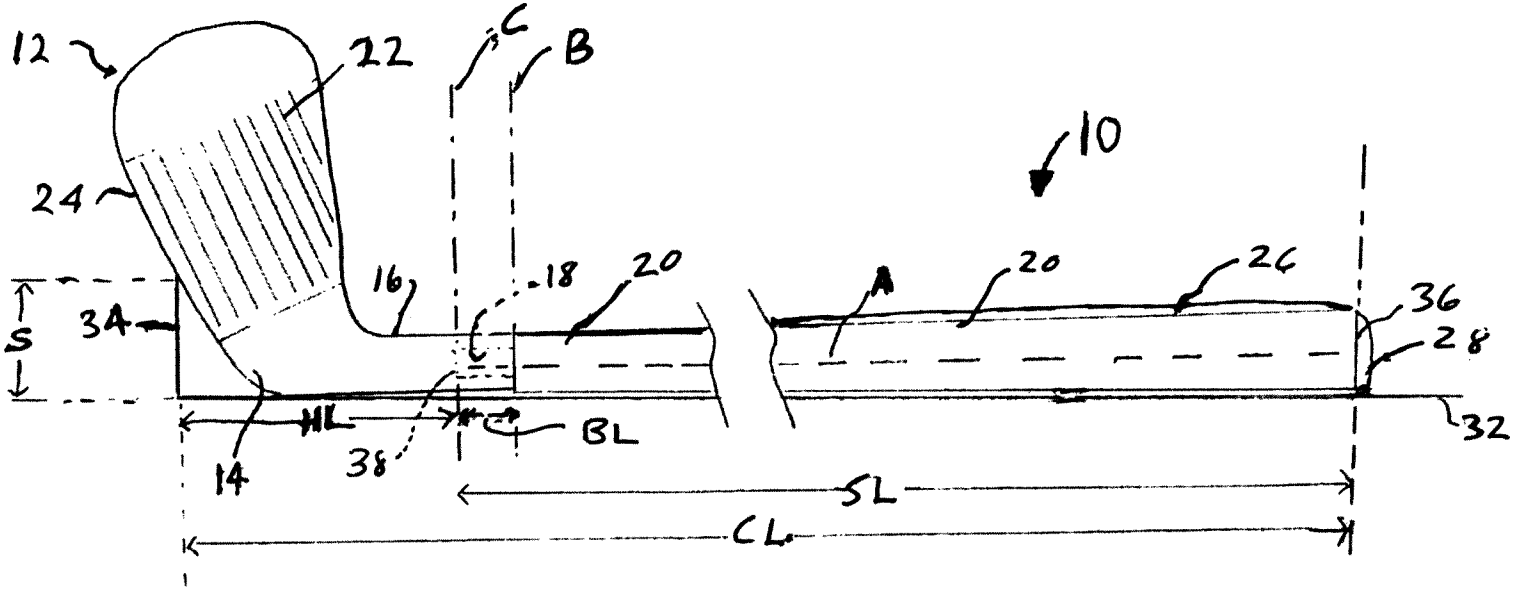
FIG. 2 is a front elevation view of a golf club fitting apparatus, in accordance with embodiments of this disclosure.

FIG. 2 illustrates a golf club fitting apparatus that includes a reference club 10 comprising the components of a conventional golf club; in this specific example, a wedge. The reference club 10 has a club head 12 having a heel 14 merging into a hosel 16 having a bore 18, into which the bottom end of a shaft 20 is removably inserted. The club head 12 has a striking face 22 and a bottom or sole 24. A resilient grip 26 is fitted onto the upper portion of the shaft 20. A grip cap 28 typically terminates the grip 26 and covers the top end of the shaft 20 (i.e., the end of the shaft 20 opposite the hosel 16).

The reference club 10 is used in conjunction with a measurement device to measure golf club dimensions for fitting a golf club to a particular golfer in accordance with this disclosure. The measurement device includes a linear measurement element 32 with a stop member 34 at one end. The linear measurement element 32 is marked in the desired measurement units (typically inches and fractions thereof; alternatively in cm and mm). In use, the reference club 10 is oriented relative to the measurement device so that, when the linear measurement element 32 is horizontal, with the stop member 34 projecting vertically upward, the heel 14 of the club head 12 and the grip 26 of the reference club 10 are resting on the linear measurement element 32, the striking face 20 of the club head 12 is generally vertically oriented, the sole 22 of the club head 12 rests against the stop member 34, and the longitudinal axis A of the club shaft 14 is substantially parallel to the linear measurement scale 32. Once the reference club 10 is properly oriented relative to the measurement device, the club length CL is read from the linear measurement element 32 at a juncture 36 between the grip 24 and the grip cap 26. Those skilled in the art will appreciate that the grip cap 26 is not included in the club length measurement CL.

The shaft length SL is a measurement of the shaft 20 from the grip/grip cap juncture 36 to the lower end of the shaft 20 (shown housed in and contacting a shaft seating surface 38 in the hosel 16). The bore length BL is a length of the bore 18 between the top of the hosel 16 (where the shaft 14 enters the hosel, as indicated by the phantom vertical line B) and the shaft seating surface 38 in the hosel 16 (as indicated by the phantom vertical line C). In one embodiment, the bore length BL may be measured along the shaft axis A when the shaft 14 is inserted into the bore 18 of the hosel 16. In another embodiment, the bore length BL may be pre-measured before the shaft 14 is inserted into the hosel bore 18.

The hosel length HL is a measurement of the distance between the stop element 34 and the shaft seating surface 38 in the hosel 16. This measurement may be read from the linear measurement element 32 at the position of the shaft seating surface 38 in the hosel 16 (i.e, at a position coincident with the line C).

The fitting apparatus, including the reference club 10 and the measurement device of FIG. 2, having been described, several exemplary embodiments are described below.

Embodiment 1

In one embodiment, provided is a line of eight wedge club heads of a set (e.g., a 46° PW, a 48° PW, a 50° GW, a 52° AW, a 54° SW, a 56° SW, a 58° LW and a 60° LW). By configuring the hosel length HL of each club head, a single shaft can be used interchangeably between each wedge of the set in order to achieve the desired club length CL.

With respect to a standard length, Table 1 illustrates data (in inches) for each of the eight wedge club heads, including 1) hosel length HL, 2) bore length BL, 3) shaft length SL, and 4) club length CL.

TABLE 1

| SET OF WEDGES | | | | |
|---|---|---|---|---|
| | HL | BL | SL | CL |
| 46° PW | 2.22 | 0.354 | 33.28 | 35.5 |
| 48° PW | 2.22 | 0.354 | 33.28 | 35.5 |
| 50° GW | 2.095 | 0.354 | 33.28 | 35.375 |
| 52° AW | 2.095 | 0.354 | 33.28 | 35.375 |
| 54° SW | 1.97 | 0.354 | 33.28 | 35.25 |
| 56° SW | 1.97 | 0.354 | 33.28 | 35.25 |
| 58° LW | 1.845 | 0.354 | 33.28 | 35.125 |
| 60° LW | 1.845 | 0.354 | 33.28 | 35.125 |

The hosel length HL corresponds to HL of FIG. 2, and decreases in a 0.125 in. increment for every 4° increase in loft. The bore length BL corresponds to BL of FIG. 2, and is constant throughout the set at 0.354 in. The desired standard club length CL corresponds to CL of FIG. 2, and also decreases in a 0.125 in. increment for every 4° increase in loft. With these above dimensions, the shaft length SL is able to be maintained at a constant 33.28 in. throughout the set. In this manner, one shaft can be removably inserted into each of the eight club heads during a fitting process. Essentially, by varying the hosel length HL from club head to club head, the shaft length SL can be kept constant to achieve the desired club length CL.

Under the prior art method of golf club fitting, there might not be a direct correlation between the hosel length HL and the club length CL. In other words, by maintaining a constant difference between CL and HL throughout the set as shown in Table 1, a constant shaft length SL may be achieved for a standard length club CL. Similar principles may be applied to extended length shaft lengths and shortened shaft lengths (e.g., ±0.5 in.)

Embodiment 2

Assumptions:

A. There are three wedge club heads that are to be fitted: (1) a 46° pitching wedge, (2) a 50° gap wedge, and (3) a 58° lob wedge).

B. Each club head can be fitted with either a Brand X shaft or a Brand Y shaft.

C. For the 46° pitching wedge club head, the standard club length CL is 35.5 in. However, the standard club length may be increased or decreased by 0.5 in. for customization purposes. Essentially, the club length CL may be represented as 35.5±0.5 in. Similarly, for the 50° gap wedge club head, the available club lengths are 35.375±0.5 in. For the 58° lob wedge club head, the available club lengths are 35.125±0.5 in.

D. For each club length, three different degrees of stiffness or "flexes" are available: (1) A-flex, (2) R-flex, and (3) S-flex.

Under this set of assumptions (which are generally abbreviated for the sake of clarity and brevity), and using the above equation (1), 54 different shafts are required to provide a full library of customizable shaft options for the three wedge club heads under a prior art fitting method. Essentially, each shaft configuration requires its own shaft.

The proposed solution aims to create a system where the number of shafts required to achieve each of the club lengths in the assumptions above is reduced to only 18. Stated differently, instead of needing $S=\Sigma_{i=1}^{n}B\cdot CL\cdot SL$, the number of shafts required (denoted as S2) can be expressed as B·CL·SL. Notably, no summation is needed for each additional wedge club head. In this, case, the total number of shafts can be reduced by ⅔, i.e., from 54 to 18. Where a large number of club heads are in the library, the reduction in the number of shafts becomes even more significant. Furthermore, the advantage becomes even more magnified where the storage space is very limited (e.g., a fitting cart or fitting display).

Different club characteristics such as (1) bore length BL, (2) hosel length HL, and (3) shaft length SL, are defined as shown in FIG. 2. Generally, the equation for the club length CL is as follows:

$$CL=SL+HL, \tag{2}$$

where SL is the shaft length and HL is the hosel length.

To achieve the reduction in the total number of shafts, a constant differential between club length and hosel length throughout the different wedges may be maintained. That is, $CL_{PW}-HL_{PW}=CL_{GW}-HL_{GW}=CL_{LW}-HL_{LW}$. By ensuring this relationship, the usage of one shaft for each of the standard club lengths is guaranteed. In a similar manner, the "Standard length+0.5 in." extended shaft can be reduced to one shaft across the wedges, and the "Standard length−0.5 in." shortened shaft can also be reduced to one shaft across the wedges. Thus, only three shafts are needed for each brand at each shaft stiffness, enabling the reduction to 18 shafts using the novel proposed method from 54 shafts using the prior art method.

Furthermore, another advantageous feature of the present invention is that no additional shafts are needed even where additional wedges are added to the library. For example, adding a 54° sand wedge does not require any additional shafts when the brands supplied, the shaft stiffness options. etc. are unchanged. With respect to Example 1, under the prior art method, each additional wedge added to the library would require another 18 shafts.

In one embodiment, with respect to a standard club length across several different wedge lofts, the standard club length may decrease by a constant length decrease increment D, proportional to an increase in loft. That is, the relationship of standard club length of a 46° pitching wedge with respect to a 50° gap wedge may be expressed as:

$$CL_{50}=CL_{46}-D, \tag{3}$$

where D is the length decrease increment.

Similarly, the length decrease increment D should also be applied to the hosel lengths:

$$HL50=HL46-D. \tag{4}$$

In one embodiment, D is set at 0.125 in. Accordingly, given a 35.5 in. standard club length for a 46° pitching wedge, the 50° gap wedge would have a 35.375 in. standard club length. This relationship holds across extended club lengths and shortened club lengths. So, given an extended club length of 36 in. for a 46° pitching wedge (35.5+0.5 in.), the 50° gap wedge would be 35.875 in. (35.375+0.5 in.).

In one or more embodiments, the 0.125 in. differential is customizable (e.g., 0.25 in., 0.5 in., etc.).

Also, in one or more embodiments, the length decrease increment D correlates to a total decrease increment $D_{max}$. In one or more embodiments. $D_{max}=D\times(N-1)$, where N is the number of wedges in the set. In Embodiment 1, $D_{max}=D\times M$, where M is the number of times the length decrease increment D is decremented throughout the set (M=3 in Embodiment 1). Stated differently, Embodiment 1 has a $D_{max}$=0.375 in. In one or more embodiments, $D_{max}$ is subject to a constraint. Namely. $D_{max}$ cannot exceed the hosel length HL of the highest lofted wedge (e.g., a 58° SW if the 58° SW is the highest lofted wedge in the set). In other words, in this example, $D_{max} \leq HL_{SW}$.

So, with the relationships and constraints discussed above, the various hosel lengths HL can be determined for each wedge of the set, corresponding to a particular shaft length SL. Notably, CL and BL are generally given and may be set accordingly.

Embodiment 3

Figure 3:
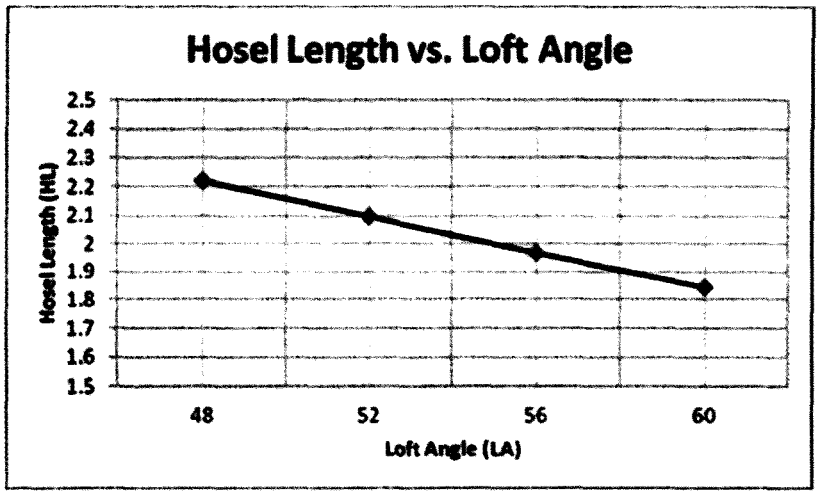
FIG. 3 is a graph of hosel length versus loft angle for use in accordance with an embodiment of this disclosure.

In one or more embodiments, the hosel length is correlated with the loft angle. As shown in the graph of FIG. 3, as the loft angle increases, the hosel length decreases.

Furthermore, the factor or increment by which the hosel length decreases is constant when moving from a wedge of a first loft and the next two consecutive increasingly lofted wedges (e.g., moving from a 46° wedge to a 50° wedge to a 54° wedge). Indeed, this hosel length decrease increment can be represented as a rate of change R in hosel length per degree change in loft angle. For example, R may be between 0.025 in. and 0.0350 in. per degree. In this embodiment, R is 0.03125 in./degree.

The relationship between the various differently lofted wedges of a set may satisfy:

$$(HL_1-HL_2)=R^*(LA_2-LA_1), \quad (5)$$

where $HL_1$ and $HL_2$ represent hosel lengths of the respective wedges, and $LA_1$ and $LA_2$ represent the loft angles of the respective wedges. As shown, the loft angle of each of the wedges differs from the loft angle of another wedge by at least 4°. However, other configurations are possible.

The above expression relates the hosel length and loft angles of various wedges. With any given wedge, however, a relationship between its hosel length and loft angle may also exist. For instance, in one or more embodiments, a theoretical $HL_0$ at zero degree loft can be extrapolated from the data of Embodiment 3 to be 3.72 in. By using this theoretical $HL_0$, the expression for correlating loft angle to hosel length of a wedge of any loft angle LA may be determined as:

$$HL_{LA}=3.72 \text{ in}-(0.03125 \text{ in./°})^*LA. \quad (6)$$

In one or more embodiments. $HL_{LA}$ can be broadly expressed as:

$$3.66 \text{ in.}-(0.03125 \text{ in./°})^*LA \leq HL_{LA} \leq 3.78 \text{ in.}-(0.03125 \text{ in./°})^*LA. \quad (7)$$

In one or more embodiments. $HL_{LA}$ can be expressed according to:

$$3.70 \text{ in.}-(0.03125 \text{ in./°})^*LA \leq HL_{LA} \leq 3.74 \text{ in.}-(0.03125 \text{ in./°})^*LA. \quad (8)$$

Figure 4:
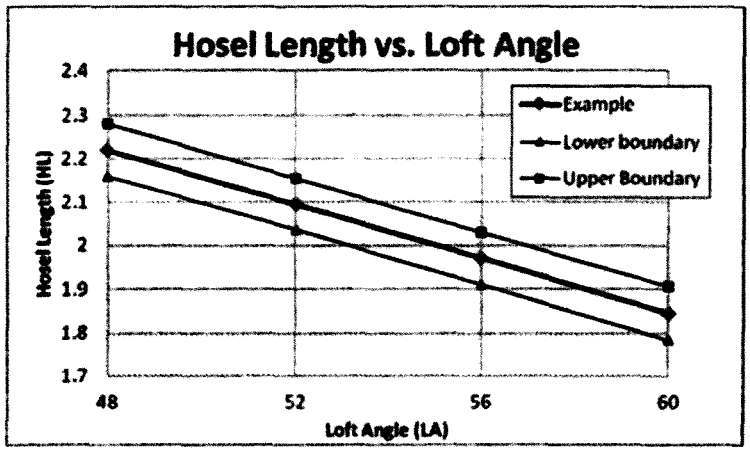
FIG. 4 is a graph of hosel length versus loft angle for use in accordance with another embodiment of this disclosure.

Expressions (7) and (8) are supported by the following table (Table 2) and the graph of FIG. 4. The loft angle LA is shown in degrees, while the hosel length HL lower boundary and upper boundary are shown in inches. As further shown in Table 2, the maximum hosel length of a set $HL_{max}$ is equal to the hosel length of the lowest lofted club in the golf club fitting system (in the example shown in Table 2, the club head with the 48° loft angle).

TABLE 2

| Loft Angle (LA) | Hosel Length (HL) | Lower boundary | Upper boundary |
|---|---|---|---|
| 48 | 2.22 | 2.16 | 2.28 |
| 52 | 2.095 | 2.035 | 2.155 |
| 56 | 1.97 | 1.91 | 2.03 |
| 60 | 1.845 | 1.785 | 1.905 |

While certain embodiments have been described herein, one of ordinary skill in the art will recognize that the above principles can still be applied to other correlated sets of golf clubs types or mixed golf club types. Furthermore, the construction of the wedge has been simplified for the sake of brevity and clarity and should be not construed as limiting the claims. Indeed, the above described concepts are equally applicable to golf clubs having shaft sleeves, etc.

What is claimed is:

1. A golf club fitting system, comprising:

a plurality of wedge-type golf club heads including:

a first club head having:

a first striking face;

a first main body;

a first hosel extending from the first main body;

a first loft angle $LA_1$; and a first hosel length $HL_1$;

a second club head having:

a second striking face;

a second main body;

a second hosel extending from the second main body;

a second loft angle $LA_2$ greater than the first loft angle $LA_1$, a difference between the second loft angle and the first loft angle being no more than 15°; and a second hosel length $HL_2$ less than the first hosel length $HL_1$ by at least 0.340 inches;

a third club head having:

a third striking face;

a third main body;

a third hosel extending from the third main body;

a third loft angle $LA_3$ greater than the first loft angle and less than the second loft angle; and a third hosel length $HL_3$ less than the first hosel length $HL_1$ and greater than the second hosel length $HL_2$; and a fourth club head having:

a fourth striking face;

a fourth main body;

a fourth hosel extending from the fourth main body;

a fourth loft angle greater than the first and third loft angles and less than the second loft angle; and a fourth hosel length $HL_4$ less than the first and third hosel lengths $HL_1$ and $HL_3$ and greater than the second hosel length $HL_2$;

a plurality of shafts each having the same shaft length, at least some of the plurality of shafts differing in brand identification and at least some of the plurality of shafts differing in shaft stiffness; and a container configured to store the plurality of wedge-type golf club heads and the plurality of shafts.

2. The golf club fitting system of claim 1, wherein (i) the difference $D_{13}$ between the first hosel length $HL_1$ and the third hosel length $HL_3$, (ii) the difference $D_{34}$ between the third hosel length $HL_3$ and the fourth hosel length $HL_4$, and (iii) the difference $D_{42}$ between the fourth hosel length $HL_4$ and the second hosel length $HL_2$ are substantially equal to each other.

3. The golf club fitting system of claim 2, wherein the differences $D_{13}$, $D_{34}$, and $D_{42}$ substantially equal 0.125 in.

4. The golf club fitting system of claim 3, wherein (i) the difference between the first loft angle and the third loft angle; (ii) the difference between the third loft angle and the fourth loft angle; and (iii) the difference between the fourth loft angle and the second loft angle substantially equal 4°.

5. The golf club fitting system of claim 1, wherein:

the third loft angle is greater than the first loft angle by no more than 5°; and the third hosel length $HL_3$ is less than the first hosel length $HL_1$ by at least 0.120 inches.

6. The golf club fitting system of claim 1, wherein:

the first and second golf club heads satisfy the following:

$$(HL_1-HL_2)=R*(LA_2-LA_1);\text{ and}$$

R is within the range of 0.025 in./° to 0.035 in./°.

7. The golf club fitting system of claim 1, wherein the first, second and third golf club heads are respectively configured to satisfy the following:

$$3.66\text{ in.}-(0.03125\text{ in./°})*LA_1\leq HL_1\leq 3.78\text{ in.}-(0.03125\text{ in./°})*LA_1;$$

$$3.66\text{ in.}-(0.03125\text{ in./°})*LA_2\leq HL_2\leq 3.78\text{ in.}-(0.03125\text{ in./°})*LA_2;\text{ and}$$

$$3.66\text{ in.}-(0.03125\text{ in./°})*LA_3\leq HL_3\leq 3.78\text{ in.}-(0.03125\text{ in./°})*LA_3.$$

* * * * *